US006217120B1

(12) United States Patent
Pugliese

(10) Patent No.: US 6,217,120 B1
(45) Date of Patent: Apr. 17, 2001

(54) ARTICLE OF SEATING FURNITURE

(75) Inventor: Joseph S. Pugliese, Lewisberg, PA (US)

(73) Assignee: Brodart Co., Williamsport, PA (US)

( * ) Notice: Subject to any disclaimer, the term of this patent is extended or adjusted under 35 U.S.C. 154(b) by 0 days.

(21) Appl. No.: 09/464,104

(22) Filed: Dec. 16, 1999

(51) Int. Cl.[7] ..... A47C 7/00
(52) U.S. Cl. ..... 297/440.1
(58) Field of Search ..... 297/440.1, 440.23, 297/440.15, 451.3, 451.8, 440.14, 445–1, 452.18, 452.19; 403/205, 231, 403

(56) References Cited

U.S. PATENT DOCUMENTS 3,799,611 * 3/1974 Steinfeld .
4,616,950 * 10/1986 Morris .
4,828,324 * 5/1989 Putnam .
5,277,476 * 1/1994 Caldwell .
5,743,672 * 4/1998 Cline .
5,890,767 * 4/1999 Chang .

* cited by examiner

*Primary Examiner*—Milton Nelson, Jr.
(74) *Attorney, Agent, or Firm*—Levine & Mandelbaum

(57) ABSTRACT

An article of seating furniture, e.g., a chair, includes two substantially parallel panels arranged in spaced-apart generally vertical planes. Each panel is formed of a pressed composition wood product, e.g., particleboard or fiberboard. A plurality of connector strips extend between the two panels so as to interconnect the panels. Hardware for securing each end of each connector strip to one of the panels includes a pair of plates sandwiching the panel between them, and a plurality of fasteners extending through a plurality of aligned holes in each of the plates and the panel for tightly joining together the pair of plates and the panel sandwiched between the plates. One of each pair of plates is part of an angle, one wing of which is the plate and the other wing of which is attached to the connector strip. Preferable, three fasteners, which may be bolts, pass through each pair of plates in the panel located between the pair, and the three bolts are arranged in a triangular pattern. Each panel may be rectangular, the lower edge of the panel resting on the floor and the upper edge of the panel serving as an arm rest. The furniture includes a seat and a back, which may be upholstered, and which are supported by the connector strips.

10 Claims, 3 Drawing Sheets

ARTICLE OF SEATING FURNITURE

This invention relates to articles of seating furniture, such as chairs, love seats, and sofas, and more particularly to such furniture used in institutional environments.

Institutional seating, such as library chairs and sofas, advantageously have two characteristics in addition to comfort, namely, cost efficiency and the ability to withstand the rigors of use by the public. Furniture made of wood or metal is durable, but relatively expensive. In order to reduce the cost of seating furniture, it is desirable to employ a pressed composition wood product. Such products, sometimes called particleboard and fiberboard, comprise wood particles or wood fibers combined with a binder and subjected to extremely high pressure which bonds the mixture into a rigid board or panel. Such a composition product has adequate strength for utilization in making furniture. However, they lack one characteristic of natural wood, namely, resilience.

When furniture of the type to which the present invention relates is assembled, the parts are usually joined by suitable fasteners, such as screws or bolts. In use, the attachment points defined by the fasteners are subjected to large stresses when library patrons, or other users of institutional furniture, drop into the seats, sit on the arms of the furniture, or lean on the backs. When the furniture is made of natural wood, these stresses of the metal fastening hardware against the wood are absorbed by the wood and due to its natural resilience, the wood has the ability to bounce back and thereby accommodate rigorous use over a long period of time.

However, pressed composition wood products are relatively brittle, and thus do not have the ability of natural wood to absorb and rebound from stresses. Instead, such products tend to wear, even crumble, at the points where parts are fastened together. For example, bolt heads even when surrounded by individual washers tend to dig into the surface of the pressed composition products thereby chewing into the surface and, over time, wearing it away. As a consequence, the fastened joints soon become loose and the chair becomes wobbly.

It is an object of the present invention to overcome this problem by providing an article of seating furniture made in part of a pressed composition wood product, for the sake of cost efficiency, while at the same time employing a fastening arrangement able to perform in an institutional environment, over a long period of time, without loosening and thereby compromising the rigidity of the furniture.

Additional features and objects of the invention will be apparent from the following description, in which reference is made to the accompanying drawings.

The chair chosen to illustrate the present invention, and shown in FIGS. 1–4, includes two side panels 10 and 11 substantially parallel to each other and arranged in spaceapart generally vertical planes. Each of the panels is formed of a pressed composition wood product, such as particleboard or fiberboard. These composition products comprise wood particles or wood fibers mixed with a binder and then highly compressed to produce a flat board. Another possible pressed composition wood product which might be used is chipboard, which is similar to particleboard and fiberboard, except that it is made using larger wood chips. Because chipboard is usually not as strong as particle board or fiberboard, the two former products are preferred for the purposes of the present invention.

Extending between the panels 10 and 11 are three horizontal and parallel connector strips, or stretchers, 12, 13, and 14. The connector strips serve to maintain side panels 10 and 11 in upright condition, and also serve to support the chair seat and back as will be described in more detail below.

Figure 1:
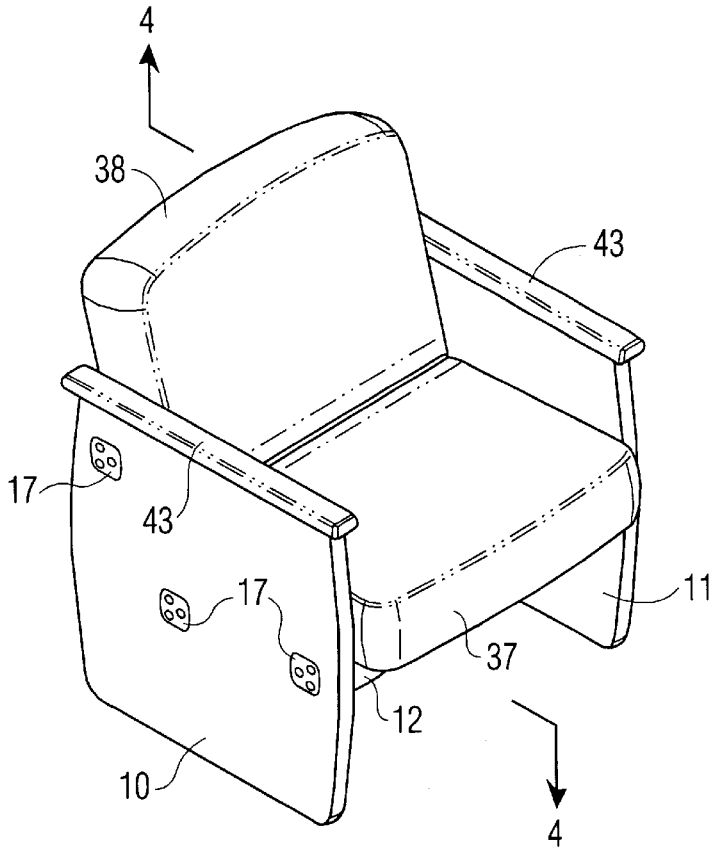
FIG. 1 is a perspective view from the top, front, and right side of a chair according to the present invention.
Figure 2:
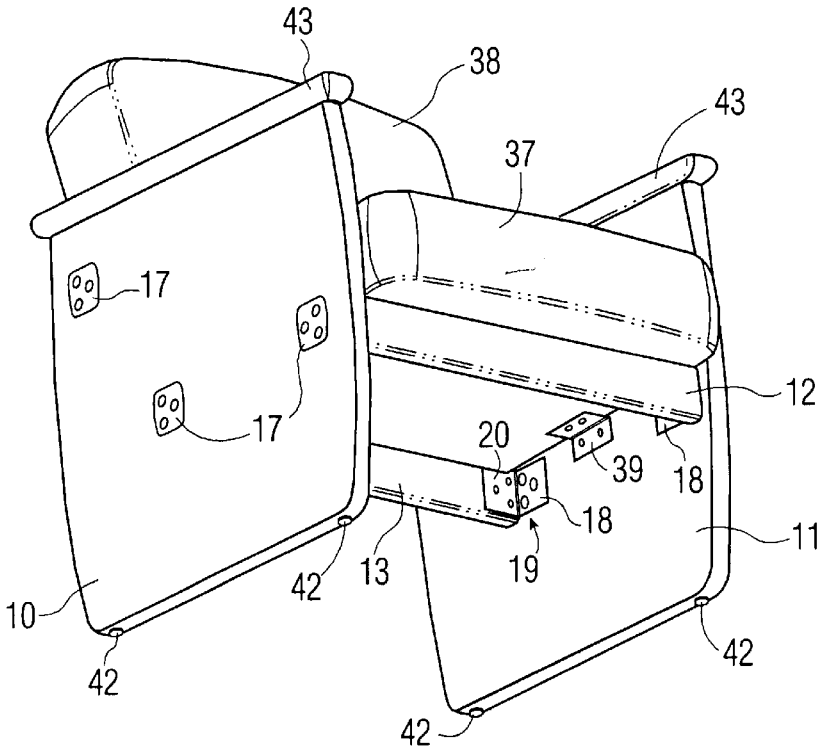
FIG. 2 is a perspective view of the chair from the bottom front and right side.
Figure 3:
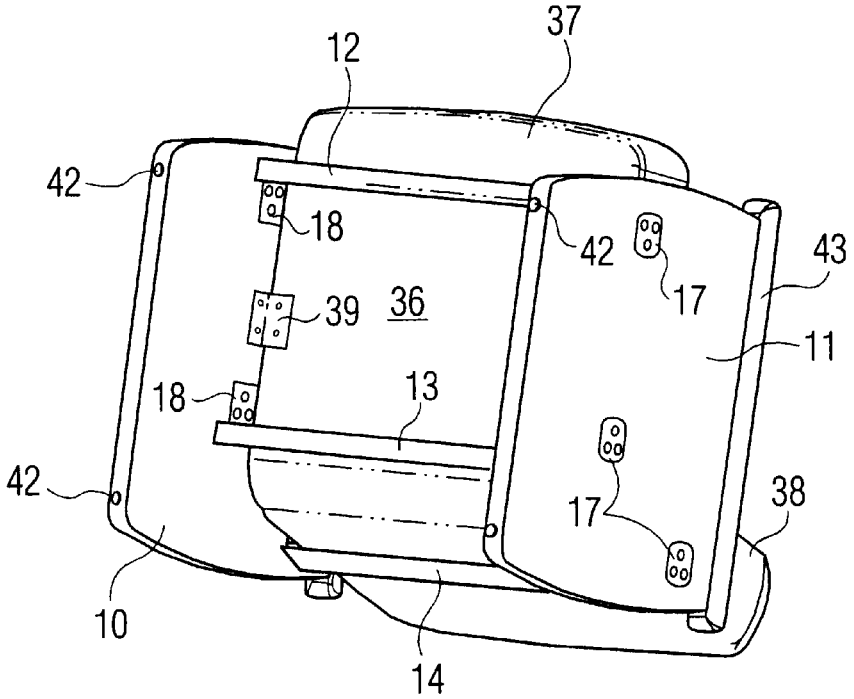
FIG. 3 is a perspective view of the chair from the bottom rear, and left side.
Figure 4:
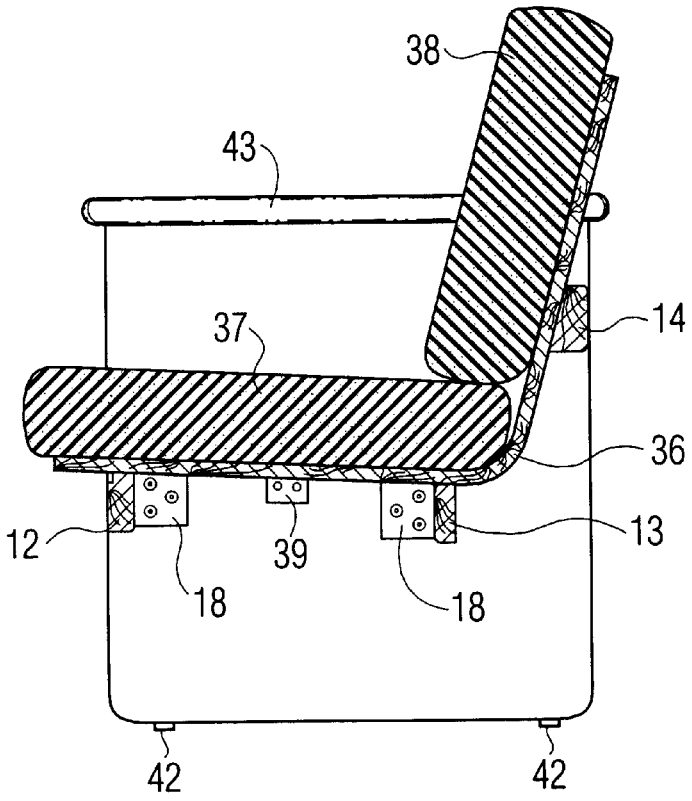
FIG. 4 is a cross-sectional taken along line 4—4 of FIG. 1.
Figure 5:
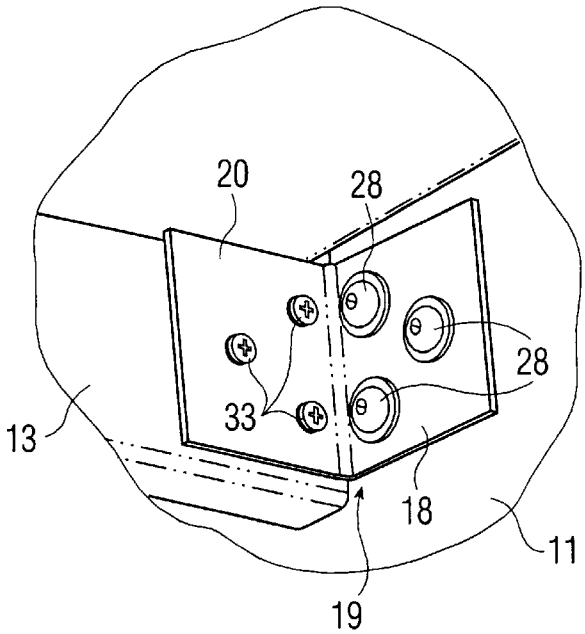
FIG. 5 is a fragmentary view, on an enlarged scale, of a hardware connection shown in FIG. 2.
Figure 6:
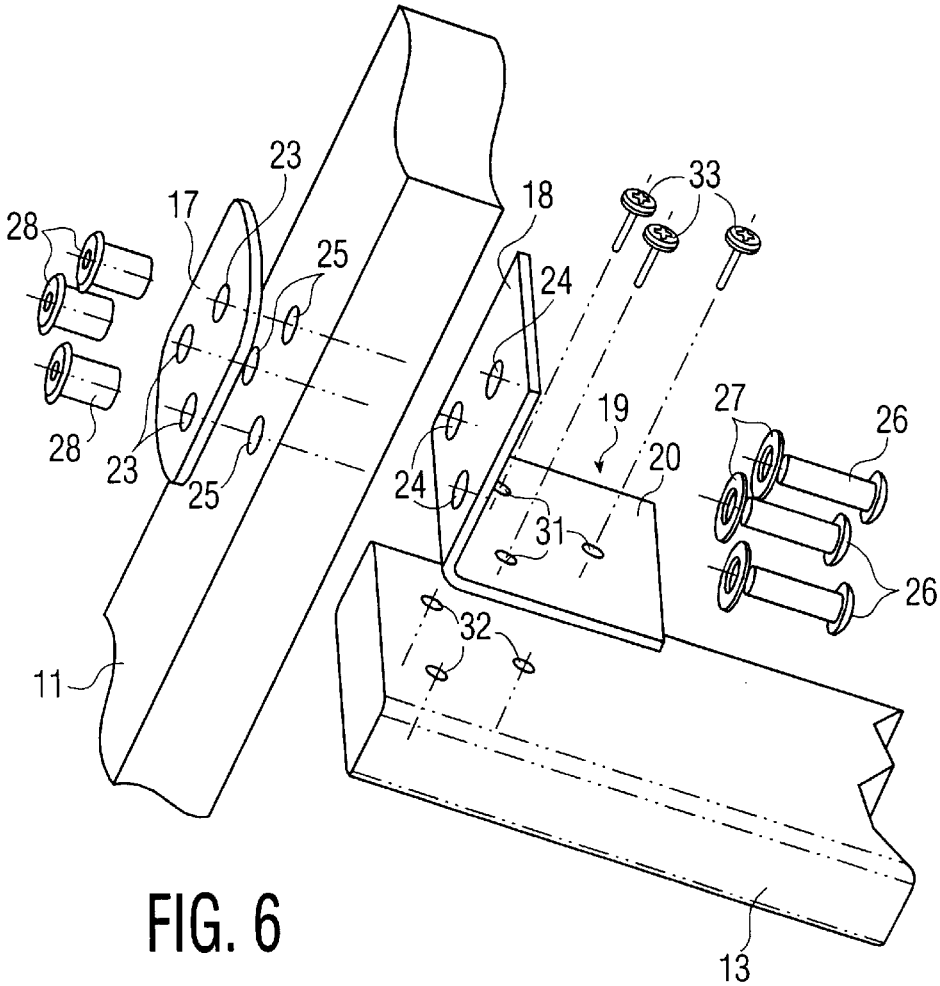
FIG. 6 is an fragmentary exploded view, on an enlarged scale, of an assembled joint of the chair.

Each end of each connector strip is secured to its respective side panel by a hardware arrangement, best seen in FIGS. 2, 5, and 6. Since all six securements of the ends of connector strips 12, 13, and 14 to the side panels 10 and 11 are identical, only one will be described, namely, the securement of one end of connector strip 13 to side panel 11.

The hardware, all of which may be made of metal, includes an outer, generally rectangular, plate 17, and an inner rectangular plate 18, the latter forming one wing of an angle 19, the angle having another wing 20. Plates 17 and 18 sandwich between them side panel 11. Plate 17 is provided with three holes 23, plate 18 is formed with three holes 24, and side panel 11 is formed with three holes 25. The three holes in each of the plates and the panel are arrayed in a triangular pattern, and each hole 23 in plate 17 is aligned with one of the holes 24 in plate 18 and one of the holes 25 in panel 11.

Three threaded bolts 26, each surrounded by a washer 27, pass through the series of aligned holes 23, 24, and 25, from the inner face of plate 18 to and beyond the outer face of plate 17. Internally threaded tubular nuts 28 are threaded on to the bolts 26 and tightened, so that side panel 11 is firmly sandwiched between plates 17 and 18.

Wing 20 of angle 19 is formed with three holes 31 in a triangular pattern which register with three starter holes 32 formed near the end of connector strip 13. By means of three wood screws 33, wing 20 of angle 19 is firmly fastened to connector strip 13, thereby securing the end of connector strip 13 to side panel 11.

The chair seat and back may be fabricated of a generally L-shaped piece of plywood 36 (FIGS. 3 and 4) to which an upholstered seat 37 and upholstered back 38 are secured. The seat portion of plywood 36 rest upon connector strips 12 and 13, and the back portion of plywood 36 rests against connector strip 14. The width of plywood 36, as well as seat 37 and back 38, is about equal to the spacing between side panels 10 and 11. To hold the unitary seat and back in place, it is desirable to employ two angles 39, one wing of each angle 39 being secured to the inner face of one of the side panels 10, 11, and the other wing of each angel 39 being secured to the bottom of the seat portion of plywood 36.

The lower edge of each side panel 10, 11 is preferable provided with a pair of metal or plastic discs 42, serving as feet for the chair. Along its upper edge, each side panel 10, 11 may have fixed to it a finishing strip of wood or plastic serving as an arm rest 43.

The example of the invention described above is a single-occupancy chair. However the article of furniture of the present invention could be of about double that length, to provide a love seat, or even longer to form a sofa. In the case of a longer piece, an intermediate panel, or panels, may be employed in addition to the side panels 10 and 11. In such a case, connector strips 12–14 extend between each two successive panels and are secured to those panels as described above.

The hardware securing arrangement between side panels and connecting strips described above has been found to remain tight despite subjecting the furniture to rigorous testing, so that the seat retains its rigid structure and avoids becoming shaky or wobbly. It is believed that this beneficial effect results in part from the use of enlarged plates 17 and 18, each of which accommodates a plurality of fasteners 26, 28. The large plates resist the tendency of the bolt heads and nuts to dig into the surfaces of panels 10 and 11. Also, the triangular pattern of the fasteners appears to add strength, possibly due to exhibiting a "truss" effect, which tends to resist lateral motion of the fasteners during use.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. An article of seating furniture comprising:

two substantially parallel side panels arranged in spaced-apart generally vertical planes, each panel being formed of a pressed composition wood product, a plurality of connector strips extending between the two panels, and hardware means securing each end of each connector strip to one of the panels, the hardware means for each connector strip end including:

a pair of plates of rigid material sandwiching the panel between them, and a plurality of fasteners extending through a plurality of aligned holes in each of the plates and the panel for tightly joining together the pair of plates and the panel sandwiched between the plates.

2. An article as defined in claim 1 wherein the plates are metal.

3. An article as defined in claim 1 wherein one of said plates is part of an angle, one wing of the angle being the plate and the other wing of the angle being attached to the connector strip.

4. An article as defined in claim 1 wherein the fasteners are bolts, and there are three bolts passing through each pair of plates and the panel located between the pair.

5. An article as defined in claim 4 wherein the three bolts are arranged in a triangular pattern.

6. An article as defined in claim 1 wherein each panel is generally rectangular, the lower edge of each panel being adapted to rest on a floor and the upper edge of each panel capable of serving as and arm rest.

7. An article as defined in claim 1 including a seat and back, the seat and back being supported by the connector strips.

8. An article as defined in claim 7 wherein the connector strips are all parallel.

9. An article as defined in claim 7 wherein there are three connector strips extending between the panels, two of the strips supporting the seat and one of the strips supporting the back.

10. An article as defined in claim 7 wherein the seat and back are upholstered.

* * * * *